US008443734B2

(12) United States Patent
Switzeny

(10) Patent No.: US 8,443,734 B2
(45) Date of Patent: May 21, 2013

(54) PIVOTING SYSTEM FOR A CHAIR

(75) Inventor: Kurt Switzeny, Brunnen (CH)

(73) Assignee: Innova Patent GmbH, Wolfurt (AT)

( * ) Notice: Subject to any disclaimer, the term of this patent is extended or adjusted under 35 U.S.C. 154(b) by 404 days.

(21) Appl. No.: 12/572,401

(22) Filed: Oct. 2, 2009

(65) Prior Publication Data

US 2010/0083867 A1 Apr. 8, 2010

(30) Foreign Application Priority Data

Oct. 2, 2008 (AT) ..... A 1546/2008

(51) Int. Cl.
*B61C 13/00* (2006.01)

(52) U.S. Cl.
USPC ..... 105/149.2; 105/149.1

(58) Field of Classification Search
USPC ..... 105/149.1, 149.2; 297/466, 467, 297/487, 488
See application file for complete search history.

(56) References Cited

U.S. PATENT DOCUMENTS

| | | | | |
|---|---|---|---|---|
| 3,353,503 | A * | 11/1967 | Pettit | 105/150 |
| 3,679,258 | A * | 7/1972 | Pender | 297/195.11 |
| 3,702,034 | A * | 11/1972 | Pfeiffer | 40/320 |
| 5,664,499 | A * | 9/1997 | Kingsmill | 104/28 |
| 6,287,211 | B1 * | 9/2001 | Bolliger et al. | 472/43 |
| 6,427,601 | B2 * | 8/2002 | Albrich | 104/87 |
| 6,520,573 | B2 * | 2/2003 | Osterle | 297/184.11 |
| 6,691,624 | B2 * | 2/2004 | Albrich | 105/149.2 |
| 6,840,179 | B2 * | 1/2005 | Begotti | 105/346 |
| 7,002,319 | B2 * | 2/2006 | Hinteregger | 320/110 |
| 7,204,559 | B2 * | 4/2007 | Berra | 297/466 |
| 7,225,744 | B2 * | 6/2007 | Gladnick et al. | 105/149.1 |
| 7,255,396 | B1 * | 8/2007 | Anikin | 297/284.9 |
| 7,677,671 | B2 * | 3/2010 | Steininger et al. | 297/488 |
| 7,690,313 | B2 * | 4/2010 | Sutter et al. | 104/117.1 |
| 7,802,523 | B2 * | 9/2010 | Moritzhuber et al. | 104/173.1 |
| 2002/0007758 | A1 * | 1/2002 | Albrich | 104/89 |
| 2002/0070599 | A1 * | 6/2002 | Berra | 297/466 |
| 2003/0006639 | A1 * | 1/2003 | Shimizu | 297/423.17 |
| 2003/0136298 | A1 * | 7/2003 | Albrich | 105/329.1 |
| 2006/0232119 | A1 * | 10/2006 | Hinteregger | 297/487 |
| 2007/0095244 | A1 * | 5/2007 | Sutter et al. | 104/112 |

(Continued)

FOREIGN PATENT DOCUMENTS

| | | | |
|---|---|---|---|
| AT | 385961 | B | 6/1988 |
| CH | 543991 | A | 11/1973 |
| JP | 6298079 | A | 10/1994 |

OTHER PUBLICATIONS

European Search Report dated Jan. 5, 2010.

(Continued)

*Primary Examiner* — Jason C Smith
(74) *Attorney, Agent, or Firm* — Laurence A. Greenberg; Werner H. Stemer; Ralph E. Locher

(57) ABSTRACT

The seat surface of a chair of a chair lift can be pivoted with the aid of a pivot mechanism. Thus, the seat surface can, while a passenger is sitting thereon, be pivoted in such a way that it extends so as to descend, or descend more markedly, toward the rear edge of the seat part. Passengers enter automatically, and independently of their size and sitting position on the chair, into a stronger, stable back position, thereby reliably counteracting slipping in the direction of the front edge of the seat part and thus slipping-through between the seat surface and transverse hoop.

22 Claims, 3 Drawing Sheets

U.S. PATENT DOCUMENTS

| | | | | |
|---|---|---|---|---|
| 2007/0221088 | A1* | 9/2007 | Hinteregger | 104/178 |
| 2008/0150346 | A1* | 6/2008 | Hinteregger | 297/488 |
| 2009/0058170 | A1* | 3/2009 | Switzeny | 297/487 |
| 2009/0151594 | A1* | 6/2009 | Dur et al. | 104/112 |
| 2010/0083867 | A1* | 4/2010 | Switzeny | 105/149.2 |
| 2010/0089276 | A1* | 4/2010 | Fischnaller | 105/149.2 |
| 2010/0089277 | A1* | 4/2010 | Osterle | 105/149.2 |
| 2010/0089278 | A1* | 4/2010 | Sutter | 105/149.2 |
| 2010/0089279 | A1* | 4/2010 | Sutter | 105/149.2 |
| 2010/0089280 | A1* | 4/2010 | Sutterluty | 105/149.2 |
| 2010/0089281 | A1* | 4/2010 | Sutter | 105/149.2 |

OTHER PUBLICATIONS

Austrian Office Action dated Aug. 18, 2009.

* cited by examiner

PIVOTING SYSTEM FOR A CHAIR

CROSS-REFERENCE TO RELATED APPLICATION

This application claims the priority, under 35 U.S.C. §119, of Austrian application A 1546/2008, filed Oct. 2, 2008; the prior application is herewith incorporated by reference in its entirety.

BACKGROUND OF THE INVENTION

Field of the Invention

The invention relates to a chair of a chair lift with at least one seat which is arranged on a frame of the seat and has a seat part and a back rest. The seat part has a seat surface and the back rest has a back rest surface and the seat part has a rear edge associated with the back rest and a front edge opposing the rear edge.

Furthermore, the invention relates to a method for operating a chair lift, a chair with at least one seat having a seat part and a back rest being moved from one station to another station. The seat part has a seat surface and the back rest has a back rest surface, the seat part has a rear edge associated with the back rest and a front edge opposing the rear edge and the back rest has a lower edge associated with the seat part and an upper edge opposing the lower edge.

Chairs for chair lifts usually have one or up to eight seat(s) positioned next to one another. In order to prevent the passengers from falling out of or slipping off the chair, these chairs usually have hoop guards which extend over the entire width of the chair. These hoop guards can be pivoted from a position in which they are located above the passengers to a position in which a transverse hoop extends before the passengers and their thighs. Furthermore, a number of foot rests corresponding to the number of seats is often also provided on the closing hoops.

Relatively small persons, in particular children, are often unable to assume the correct sitting position in which the entire back is supported on the back rest, so that they accordingly hang on to the hoop guard, in particular to the transverse hoop, as a result of which their bottom enters the region of the front edge of the seat surface. As, according to the regulations, the distance between the transverse hoop and seat surface is of dimensions such that even large passengers having relatively long legs can comfortably fit under the transverse hoop, this distance is generally too great for relatively small persons, so that it is possible for these relatively small persons to slip through under the transverse hoop, in particular if their relatively short legs prevent them from supporting their legs on the foot rests.

SUMMARY OF THE INVENTION

It is accordingly an object of the invention to provide a pivoting system for a chair which overcome the above-mentioned disadvantages of the prior art methods and devices of this general type, which reliably prevent, irrespective of the size of the person and the position in which they are sitting on the chair, slipping in the direction of the front edge of the seat and thus slipping-through between the seat surface and transverse hoop.

With the foregoing and other objects in view there is provided, in accordance with the invention a chair of a chair lift. The chair contains a frame, a pivot mechanism, and at least one seat disposed on the frame. The seat has a seat part and a back rest. The seat part has a seat surface and the back rest has a back rest surface. The seat part has a rear edge associated with the back rest and a front edge opposite the rear edge. The seat surface can be pivoted via the pivot mechanism.

As a result of the fact that the seat surface can be pivoted with the aid of a pivot mechanism, the seat surface can, while a passenger is sitting thereon, be pivoted in such a way that it extends so as to descend, or to descend more markedly, toward the rear edge of the seat part in comparison to the conventional position. The passengers' weight is then automatically deflected in the direction toward the back rest and toward the rear edge of the seat. Passengers enter automatically, and independently of their size and sitting position on the chair, into a stronger, stable back position, thereby counteracting slipping in the direction of the front edge of the seat and thus slipping-through between the seat surface and transverse hoop.

In a preferred embodiment of the invention, the seat surface and the back rest surface can be pivoted with the aid of a pivot mechanism. Thus, even if the back rest surface is pivotable, the conventional angle between the seat surface and back rest surface can, in the pivoted position of the seat, be maintained or re-established in order to maintain the sitting comfort to which the passenger is accustomed.

Preferably, the angle between the seat surface and back rest is varied relative to each other at least temporarily. Within the scope of the invention, this may be carried out in particular in that first the seat surface and afterwards the back rest surface is pivoted, or in that first the back rest surface and afterwards the seat surface is pivoted. It is also possible for only the seat surface to be pivoted, whereas the back rest surface remains permanently in the same position.

Alternatively thereto, provision may also be made for the seat surface and the back rest surface to be pivoted at the same time and if appropriate about the same pivot axis, in that the seat as a whole is pivoted. What is important is that the seat surface extends, after the pivoting, so as to descend toward the rear edge.

Furthermore, it is preferred that the seat surface and if appropriate the back rest surface be pivotable about a pivot axis extending substantially parallel to the rear edge of the seat part. Within the scope of the invention, this pivot axis can be arranged in the region of the rear edge of the seat part or in the region of the center of the seat part or in the region of the front edge of the seat part. If the pivot axis is located in the region of the rear edge of the seat part, then the front edge can be raised, whereas the position of the rear edge is not altered. If the pivot axis is located in the region of the front edge of the seat part, then the rear edge can be lowered, whereas the position of the front edge is not altered. If the pivot axis is located in the region of the center of the seat part, then the front edge can be raised, while the rear edge is lowered.

A sequence in time of the pivoting according to the invention may be illustrated, by way of example, which is now described.

A passenger sits down, as is usual in a station, on a seat of the chair of the chair lift, the seat being in the conventional position or in a position which is lowered slightly forward in relation to the conventional position. Before or during the departure of the chair from this station, the seat surface is pivoted after the entrance region in such a way that the front edge of the seat part is raised. In this case, the rear edge of the seat part may, depending on the position of the pivot axis, remain arranged in a stationary manner or be lowered accordingly. Alternatively, the seat surface can also be pivoted after the entrance region in such a way that the rear edge of the seat part is lowered while the front edge is arranged in a stationary manner. In addition, the back rest surface can be pivoted simultaneously or with a slight time offset, in that for example the upper edge of the back rest is moved counter to the direction of travel of the chair.

During the journey from the station to a subsequent station, the seat is held in this position in which the passenger automatically enters a stronger, stable back position and is pressed against the back rest.

Before the exit region of the next station, the seat surface is pivoted in such a way that the front edge of the seat part is lowered. In this case, the rear edge of the seat part may, again depending on the position of the pivot axis, remain arranged in a stationary manner or be raised accordingly. If, alternatively, the rear edge of the seat part was previously lowered while the front edge is arranged in a stationary manner, then the rear edge of the seat part is now raised while the front edge is arranged in a stationary manner. If the back rest surface was previously pivoted as described above, then the back rest surface is also pivoted into the starting position, in that simultaneously or with a slight time offset the upper edge of the back rest is moved in the direction of travel of the chair lift. The seat is back in the position described at the outset. The guest can climb out of the chair as usual.

Within the scope of the invention, each seat can have associated with it its own pivot mechanism. However, it is preferred if a pivot mechanism is jointly associated with at least two seats, in particular with all the seats. The pivot mechanism can be arranged laterally next to the chair or, depending on whether the front edge is to be raised or the rear edge lowered, in the front or in the rear region of the seat, preferably below the seat.

Within the scope of the invention, it is also possible for the pivot mechanism to extend over all or part of the width of the chair. Likewise, it is possible for the pivot mechanism to have at least one lifting and lowering device arranged at certain points, such as for example a piston arranged behind, below or laterally next to the chair or at least one seat.

Other features which are considered as characteristic for the invention are set forth in the appended claims.

Although the invention is illustrated and described herein as embodied in a pivoting system for a chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
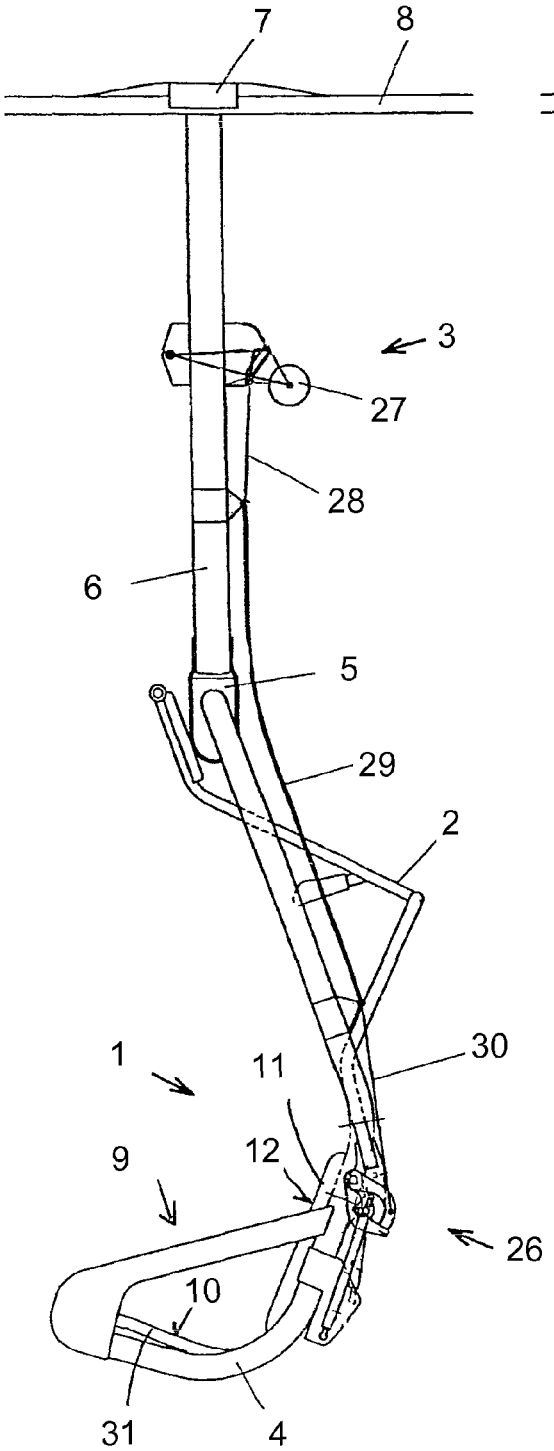
FIG. 1 is a diagrammatic, side view of a chair of a chair lift with an opened hoop guard according to the invention.
Figure 2:
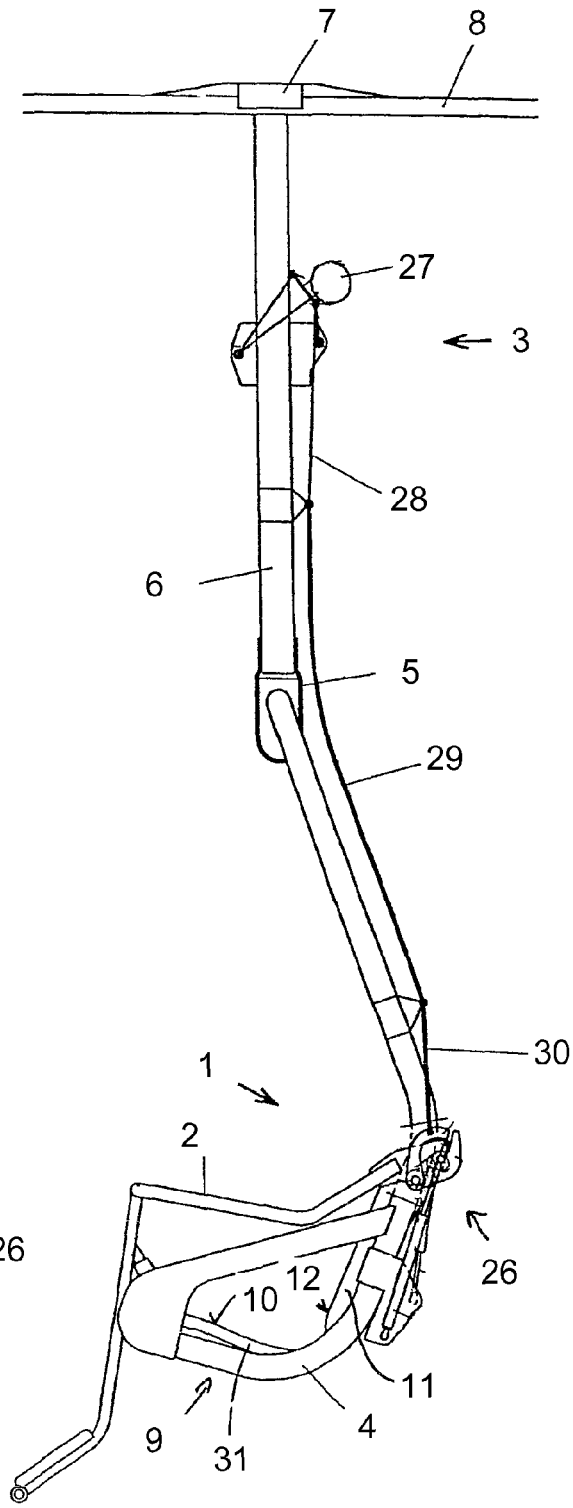
FIG. 2 is a side view of the chair from FIG. 1 with the hoop guard in a closed position.

Referring now to the figures of the drawing in detail and first, particularly, to FIGS. 1 and 2 thereof, there is shown a chair 1 of a chair lift with a hoop guard 2, which has a mechanism 3 for actuating the hoop guard 2. The remaining parts illustrated in FIGS. 1 and 2 may be configured as is conventional in the prior art. Reference is therefore merely made in general terms to the fact that the hoop guard 2 is arranged on a frame 4 which is connected via a joint 5 to a support rod 6, attached to the upper end of which is a clamping device 7 for fastening the chair 1 to a hauling cable 8. The invention may be used, independently thereof, also for other configurations of chairs, in particular couplable chairs.

Furthermore, reference is made in general terms to the fact that the chair 1 has at least one seat 9 having a seat part 31 and a back rest 11, the seat part 31 having a seat surface 10 and the back rest 11 having a back rest surface 12 and the seat part 31 having a rear edge 13 associated with the back rest 11 and a front edge 14 opposing the rear edge 13. The back rest 11 has a lower edge 15 associated with the seat surface 10 and an upper edge 16 opposing the lower edge 15.

Figure 3:
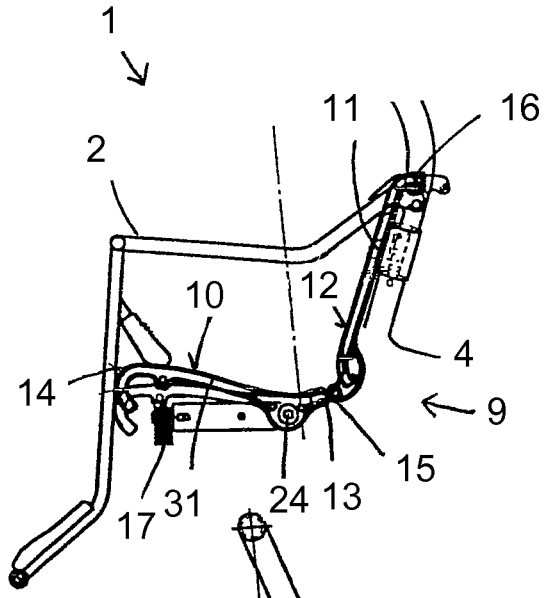
FIGS. 3 and 4 are side views of an embodiment of the chair according to the invention of a chair lift.
Figure 4:
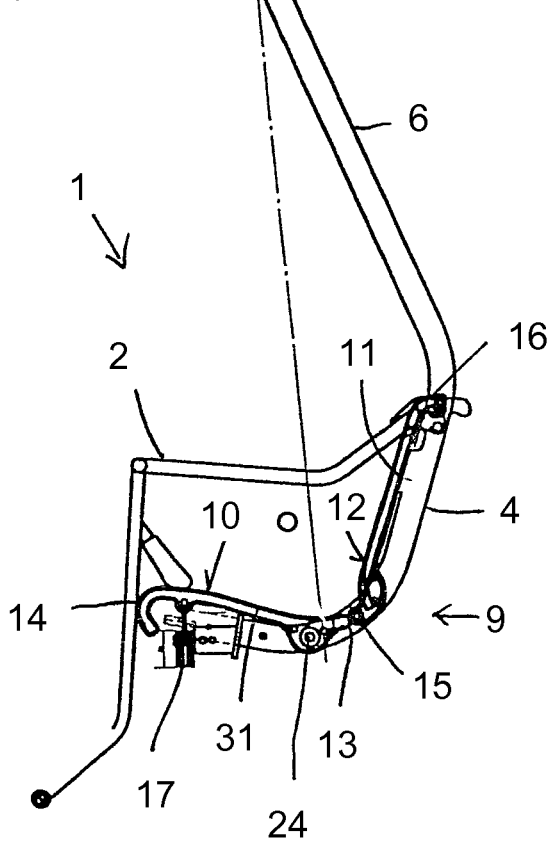
Figure 5:
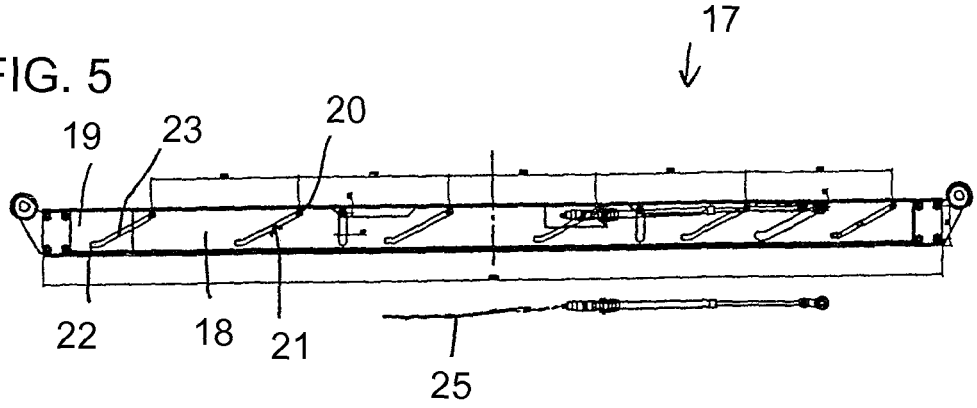
FIGS. 5 and 6 are diagrammatic, illustrations of an embodiment of a pivot mechanism.
Figure 6:
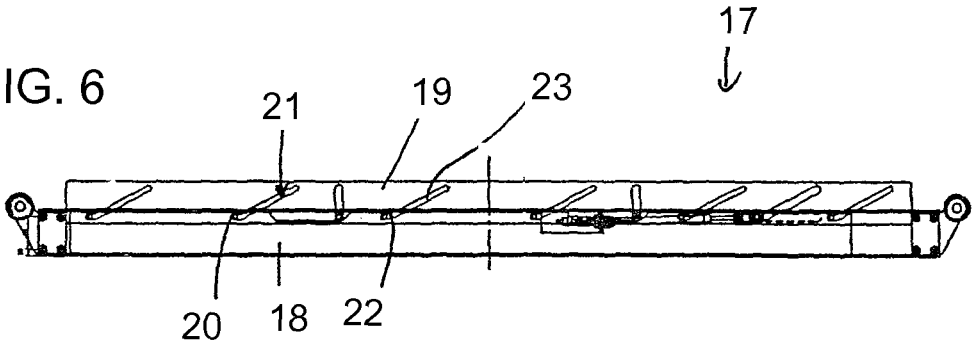

FIGS. 3 and 4 show an embodiment of the chair 1 of a chair lift in which, according to the invention, the seat surface 10 can be pivoted with the aid of a pivot mechanism 17. FIG. 3 shows two positions of the seat surface 10. The lower position is the entrance or exit position of the seat surface 10, in which the seat surface 10 extends in a manner such as it is arranged, for example, on the frame 4 in a conventional chair 1 of a chair lift. The upper position is the pivoted position of the seat surface 10, in which the seat surface 10 extends so as to descend, or descend more markedly, toward the rear edge 13 of the seat 9. The seat surface 10 is in this upper, pivoted position as the chair 1 travels from one station to another station (travel position). The pivot mechanism 17, which in FIGS. 5 and 6 may be seen more clearly from the front, is illustrated in FIG. 3 merely for the lower entrance or exit position of the seat surface 10 and corresponds to the position of the pivot mechanism 17 as shown in FIG. 5. FIG. 4 shows the pivot mechanism 17 for the travel position of the seat surface 10, corresponding to the state of the pivot mechanism 17 as shown in FIG. 6. The pivot mechanism 17 shown in FIGS. 3 to 6 is jointly associated with all the seats 9 and extends in the front region and below the seat 9. The pivot mechanism extends in this case substantially parallel to the front edges 14 of the seat 9 over the entire width of the chair 1.

The pivot mechanism 17 has in FIGS. 5 and 6 two profiles 18, 19 which are displaceable relative to each other. The lower profile 18 is displaceably mounted on the frame 4 and acts as the control profile 18. The upper profile 19 is securely connected to the underside of the seat 9 in the region of the front edges 14 thereof. The control profile 18 is shorter than the upper profile 19 so that it does not protrude beyond the width of the chair during displacing. The control profile 18 has bolts 20 which are guided within slots 21 provided in the upper profile 19. The slots 21 have a lower portion 22 extending substantially parallel to the longitudinal extension of the profiles 18, 19 and a portion 23 extending obliquely upward.

In the unpivoted state of the seat surface 9, the end of the control profile 18 that is shown on the right-hand side in FIGS. 5 and 6 is located in the region of the right-hand end of the upper profile 19, the bolts 20 of the control profile 18 being arranged in the upper end of the oblique portions 23 of the slots 21. When the control profile 18 is displaced toward the left in FIGS. 5 and 6, so that the left-hand end of the control profile 18 is then located in the region of the left-hand end of the upper profile 19, then the oblique portion 23 of the slots 21 causes the upper profile 19 to be displaced upward but not toward the side. The upper profile 19 remains securely in this position, without lowering accidentally, as the bolts rest against the outer end of the lower portion 22 of the slots 21, which portion does not allow vertical movement. The upper profile 19 and thus the front edge 14 of the seat 9 can be lowered again only when the control profile 18 is displaced back again.

In this embodiment, only the seat surface 10 is pivoted, in that the front edge 14 of the seat 9 is raised, the pivot axis 24 being arranged in the region of the rear edge 13 of the seat part 31.

The pivot mechanism 17 can be actuated with the aid of a device arranged in a station, such as for example by coupling to the mechanism 3 for actuating the hoop guard 2 (FIGS. 1 and 2). For this purpose, the mechanism 3 for actuating the hoop guard 2 can be equipped, for example, with a sheathed cable 25 which causes the displacing of the control profile 18 either directly or indirectly, for example via a device 26 for closing and blocking the opening of the hoop guard 2.

Figure 7:
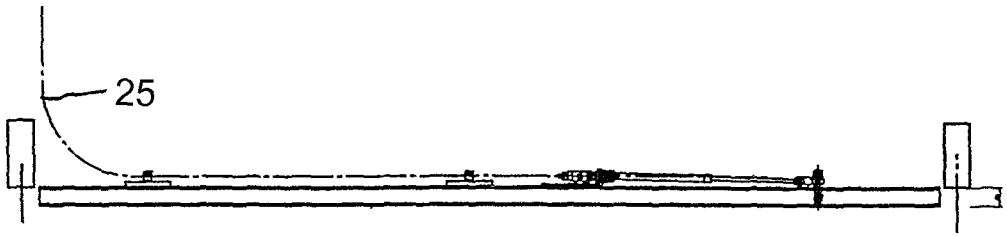
FIG. 7 is an illustration showing measures for actuating the pivot mechanism.

With reference to FIGS. 1, 2 and 7, the actuating of the pivot mechanism 17 may be presented as follows:

The mechanism 3 for actuating the hoop guard 2 has a guide roll 27 via which it is raised (FIG. 2) when the chair 1 passes through a region with a guide device, in particular a guide rail, which is associated with the guide roll 27 and is arranged in the region for departing from a station. A further guide device, for example a guide rail, which moves the guide roll 27 back into the lowered position illustrated in FIG. 1, is arranged before or in the entrance region of the station. A rod 28, which is connected to a Bowden cable 29 which is in turn connected to a second rod 30, extends from the mechanism 3 for actuating the hoop guard 2.

As the chair 1 enters a station, the support surface 9 is pivoted upward. When the guide roll 27 is lowered before or in the entrance region of a station, as in FIG. 1, then the mechanism 3 for actuating the hoop guard 2 and the Bowden cable 29 press the rod 30 downward in such a way that the device 26 for blocking the opening of the hoop guard 2 is deactivated and the hoop guard 2 is opened.

The rod 30 is connected directly or indirectly to the sheathed cable 25. The sheathed cable 25 acts, during opening of the hoop guard 2, on the pivot device 17 in such a manner that the control profile 18 is displaced in such a way (toward the right in FIGS. 5 and 6) that the bolts 22 of the control profile 18 are displaced against the upper end of the oblique portion 23 of the slots 21 of the upper profile 19. Hence, the upper profile 18, and thus the front edge 14 of the seat 9, is lowered in the region of the station, whereas the pivot axis 24 is arranged in the region of the rear edge 13 of the seat part 31.

As the chair 1 departs from the station, the guide roll 27 is raised, the rod 30 being drawn upward and the device 26 for closing the hoop guard 2 being activated. The sheathed cable 25 acts, during closing of the guard hoop 2, on the pivot device in such a manner that the control profile 18 is displaced back in such a way (toward the left in FIGS. 5 and 6) that the bolts 22 of the control profile 18 are displaced against the lower end of the substantially horizontal portion 22 of the slots 21 of the upper profile 19. Hence, the upper profile 18, and thus the front edge 14 of the seat 9, is raised in the region of the station, whereas the rear edge 13 of the seat 9 is arranged in a constant manner. The seat 9 maintains this position during travel until it enters the next station.

In summary, the exemplary embodiment of the invention is now described.

The seat surface 10 of a chair 1 of a chair lift can be pivoted with the aid of a pivot mechanism 17. Thus, the seat surface can, while a passenger is sitting thereon, be pivoted in such a way that it extends so as to descend, or descend more markedly, toward the rear edge 13 of the seat part 31. Passengers enter automatically, and independently of their size and sitting position on the chair 1, into a stronger, stable back position, thereby reliably counteracting slipping in the direction of the front edge 14 of the seat part 31 and thus slipping-through between the seat surface 10 and transverse hoop.

The invention claimed is:

1. A chair of a chair lift, the chair comprising:

a frame;

a pivot mechanism;

at least one seat disposed on said frame, said seat having a seat part and a back rest, said seat part having a seat surface and said back rest having a back rest surface, said seat part having a rear edge associated with said back rest and a front edge opposite said rear edge, said seat surface can be pivoted via said pivot mechanism; and said pivot mechanism arranged to aid in pivoting said seat surface, while a passenger sits on the seat, from an entrance position into a travel position different from said entrance position and from said travel position, and while the passenger sits on the seat, into an exit position different from said travel position.

2. The chair according to claim 1, wherein said seat surface can be pivoted about a pivot axis extending substantially parallel to said rear edge of said seat part.

3. The chair according to claim 2, wherein said pivot axis is disposed in one of a region of said rear edge of said seat part, in a region of a center of said seat part, and in a region of said front edge of said seat part.

4. The chair according to claim 1, wherein said seat surface and said back rest surface can be pivoted via said pivot mechanism.

5. The chair according to claim 1, wherein an angle between said seat surface and said back rest surface is variable.

6. The chair according to claim 1, wherein said pivot mechanism has at least two profiles which are displaceable relative to each other, a first of said profiles is displaceably mounted on said frame and a second of said profiles is securely connected to said seat.

7. The chair according to claim 6, wherein:

said second profile has a slot formed therein; and said first profile, which is displaceably mounted on said frame, has at least one bolt which is guided in said slot in said second profile connected to said seat.

8. The chair according to claim 1, wherein said pivot mechanism is disposed in a region of said front edge of said seat part and below said seat part.

9. The chair according to claim 1, wherein said pivot mechanism can be actuated with an aid of a device disposed in a station.

10. The chair according to claim 1, further comprising:

a hoop guard; and a further mechanism, said pivot mechanism coupled to said further mechanism for actuating said hoop guard.

11. A method for operating a chair lift, which comprises the steps of:

providing a chair having at least one seat with a seat part and a back rest being moved from one station to another station, the seat part having a seat surface and the back rest having a back rest surface, the seat part having a rear edge associated with the back rest and a front edge opposing the rear edge, the back rest having a lower edge associated with the seat part and an upper edge opposite the lower edge; and with an aid of a pivot mechanism and while a passenger sits on the seat surface, pivoting the seat surface in a region of the station from an entrance position into a travel position different from the entrance position, and, in the region of another station, from the travel position, and while the passenger sits on the seat, into an exit position different from the travel position.

12. The method according to claim 11, which further comprises pivoting the seat surface about a pivot axis extending substantially parallel to the rear edge of the seat part.

13. The method according to claim 11, which further comprises pivoting the seat surface about a pivot axis disposed in one of a region of the rear edge of the seat part, in a region of a center of the seat part, and in a region of the front edge of the seat part.

14. The method according to claim 11, which further comprises in a region of the station, pivoting the seat surface and the back rest surface with the aid of the pivot mechanism.

15. The method according to claim 14, which further comprises pivoting the seat surface and the back rest surface at a same time.

16. The method according to claim 14, which further comprises pivoting the back rest surface such that the upper edge of the back rest is moved, after an entrance region of the station, counter to a direction of travel of the chair and, before an exit region of the station, in the direction of travel of the chair.

17. The method according to claim 16, which further comprises carrying out the pivoting by displacing of at least two profiles, which are displaceable relative to one another, of the pivot mechanism.

18. The method according to claim 14, which further comprises carrying out the pivoting by displacing of at least two profiles, which are displaceable relative to one another, of the pivot mechanism.

19. The method according to claim 11, which further comprises varying an angle between the seat surface and back rest surface.

20. The method according to claim 11, which further comprises pivoting the seat surface such that the front edge of the seat part is raised after an entrance region of a station and lowered before an exit region of the station.

21. The method according to claim 11, which further comprises pivoting the seat surface in such a way that the rear edge of the seat part is lowered after an entrance region of the station and raised before an exit region of the station.

22. The method according to claim 21, which further comprises carrying out the pivoting by displacing of at least two profiles, which are displaceable relative to one another, of the pivot mechanism.

* * * * *